US008740485B2

(12) United States Patent
Nakashima

(10) Patent No.: US 8,740,485 B2
(45) Date of Patent: Jun. 3, 2014

(54) PRINTING APPARATUS INCLUDING AN OPEN/CLOSE LID

(75) Inventor: Shinga Nakashima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 242 days.

(21) Appl. No.: 13/184,898

(22) Filed: Jul. 18, 2011

(65) Prior Publication Data

US 2012/0020717 A1 Jan. 26, 2012

(30) Foreign Application Priority Data

Jul. 21, 2010 (JP) ..... 2010-163882

(51) Int. Cl.
*B41J 11/70* (2006.01)
*B41J 29/13* (2006.01)

(52) U.S. Cl.
USPC ..... 400/621; 400/693; 400/646

(58) Field of Classification Search
CPC ..... B41J 3/36; B41J 29/13
USPC ..... 400/88, 693, 621, 646
See application file for complete search history.

(56) References Cited

U.S. PATENT DOCUMENTS

| | | | | | |
|---|---|---|---|---|---|
| 4,905,028 | A * | 2/1990 | Okubo et al. | ..... | 347/138 |
| 7,287,850 | B2 * | 10/2007 | Matsui et al. | ..... | 347/109 |
| 7,785,025 | B2 * | 8/2010 | Harris | ..... | 400/691 |
| 2005/0036820 | A1 * | 2/2005 | Watanabe et al. | ..... | 400/621 |

FOREIGN PATENT DOCUMENTS

| | | | | | |
|---|---|---|---|---|---|
| JP | 04192396 | A * | 7/1992 | ..... | H05K 5/03 |
| JP | 8-067051 | A | 3/1996 | | |
| JP | 10049498 | A * | 2/1998 | ..... | G06F 15/02 |
| JP | 2000-043370 | A | 2/2000 | | |
| JP | 2000127556 | A * | 5/2000 | ..... | B41J 29/00 |
| JP | 2007-217165 | A | 8/2007 | | |

* cited by examiner

*Primary Examiner* — Daniel J Colilla
(74) *Attorney, Agent, or Firm* — Canon USA Inc IP Division

(57) ABSTRACT

A printing apparatus includes an open/close lid configured to close or open a paper conveyance path of a recording paper, and a locking member configured to hold a closing state of the open/close lid by engaging with an engaging portion of the open/close lid, and to be capable to move to a position engageable with the engaging portion of the open/close lid or a position of retracting from the position engageable with the engaging portion of the open/close lid. The locking member moves to the position engageable with the engaging portion of the open/close lid at non-print time, and further moves to the position of retracting from the position engageable with the engaging portion of the open/close lid at print time.

8 Claims, 7 Drawing Sheets

PRINTING APPARATUS INCLUDING AN OPEN/CLOSE LID

BACKGROUND OF THE INVENTION

1. Field of the Invention

The present invention relates to a printing apparatus. In particular, the present invention is suitable for a printing apparatus including an open/close lid that closes or opens a conveyance path of a recording paper.

2. Description of the Related Art

Conventionally, printing apparatuses based on various systems are proposed as a means for printing an image to a recording paper. With the printing apparatus, a paper feed unit feeds and conveys a recording paper for printing an image, and a printing unit therein prints the paper. The printing apparatus includes an opening for externally discharging the printed recording paper after conveying the recording paper via a paper conveyance path downstream.

In particular, the number of compact printers with high portability is recently increased. The usage environment of the printer is not limited to the indoors, furthermore, the compact printer is available with an attachable battery without requiring the plug-in connection via a cable when supplying electrical power. Therefore, the printing apparatus needs to be structured in consideration of the outdoor use. Specifically, when the opening portion, from which the recording paper in the printing apparatus is discharged, is always open, dust or a foreign matter can invade the printing apparatus from the opening portion. In particular, when the printing apparatus is carried outside, there is high possibility that sand dust invades the printing apparatus during conveyance.

If the foreign matter invades the printing apparatus, a printing operation is performed in a state in which the foreign matter adheres to the surface of the recording paper. Thus, there is fear that the quality of a printed matter deteriorates, or the printing unit is damaged, so that the printing apparatus can deteriorate earlier. Therefore, there is recently provided a printing apparatus having an openable and closable lid capable of opening or closing an opening portion to prevent a foreign matter from invading. To prevent a recording paper from falling on the floor when the recording paper is externally discharged from the printing apparatus, there is provided a printing apparatus having a paper stacking unit such as a paper discharge tray. Moreover, there is a printing apparatus in which a part of an exterior casing forms a lid having both a function for preventing the foreign matter from invading and a function as the paper discharge tray.

However, if the lid is arranged on the paper conveyance path, when a user carelessly starts the printing operation in a closing state of the lid, and the leading edge of the conveyed recording paper thus collides with the inside of the lid since the paper conveyance path is closed. In this case, there is a problem that the recording paper is not subsequently conveyed, the recording papers are stuck in the printing apparatus, and paper jam occurs.

As a jam preventing mechanism for preventing the jam, there is a technique for detecting the closing state of a paper discharge port by open/close lid with a detection sensor. With the technique, the open/close lid is opened, a detected member is consequently moved from a standby position, and the sensor detects a flag portion of the detected member. The state corresponds to an on-mode for enabling the start and continuation of a printing operation. On the other hand, by closing the open/close lid, the detected member is moved to the standby position, i.e., the position where the detected member is not detected. The state corresponds to an off-mode for disabling the printing operation. Therefore, if carelessly closing the open/close lid during the printing operation, the on-mode for enabling the detection of the detected member is changed to the off-mode for disabling the detection of the detected member, thereby suspending the printing operation.

Further, there is a technique in which the apparatus is configure to includes a biasing solenoid in conjunction with a power supply of an apparatus at an opening portion and a lever operated by energizing the solenoid, and the open/close lid is closed or opened by latching the lever thereto. The lever is rotated by energizing the solenoid at power-on and is retracted from a hook portion of the open/close lid with which the lever is engaged. Then, the latching is released and the opening portion is simultaneously opened by a spring which is biasing the open/close lid in the direction of opening the lid.

However, with the configuration including the detection sensor that detects the opening/closing state of the open/close lid, a sensor for detecting the opening/closing state is required independently of a sensor which is necessary for a normal operation. Further, there is a problem that, a circuit for controlling the sensor needs to be additionally provided, thereby increasing in costs and becoming a complicated configuration. Furthermore, there is another problem that, although printing operation is started already, if the user closes the open/close lid since there is not the printed matter in the paper stacking unit, a signal of the sensor turns off state when the open/close lid is closed and the printing operation is suspended.

With the configuration of releasing the lock by energizing the solenoid, the lock is released only at the energization time. Thus, if the user carelessly closes the open/close lid after starting the printing operation, the open/close lid is held in the closing state. Further, if releasing the lock of the open/close lid after starting the printing operation is required, the solenoid needs to be continuously energized. In addition, there is a problem of great increase in costs because the solenoid is used to control the locking operation of the open/close lid.

SUMMARY OF THE INVENTION

The present invention is directed to prevent an open/close lid from being held in a closing state thereof and a printing operation from being disturbed even if a user carelessly closes the open/close lid at print time.

According to an aspect of the present invention, a printing apparatus includes an open/close lid configured to close or open a paper conveyance path of a recording paper, and a locking member configured to hold a closing state of the open/close lid by engaging with an engaging portion of the open/close lid, and to be capable to move to a position engageable with the engaging portion of the open/close lid or a position of retracting from the position engageable with the engaging portion of the open/close lid. The locking member moves to the position engageable with the engaging portion of the open/close lid at non-print time, and further moves to the position of retracting from the position engageable with the engaging portion of the open/close lid at print time.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Hereinbelow, an exemplary embodiment of the present invention is specifically described with reference to the drawings. In the diagrams, if necessary, the front side of the printing apparatus is denoted by Fr, the back side is denoted by Rr, the right side is denoted by R, and the left side is denoted by L. According to the present exemplary embodiment, a sublimation printer (hereinafter, referred to as a printer) is described as an example of the printing apparatus.

Figure 1A:
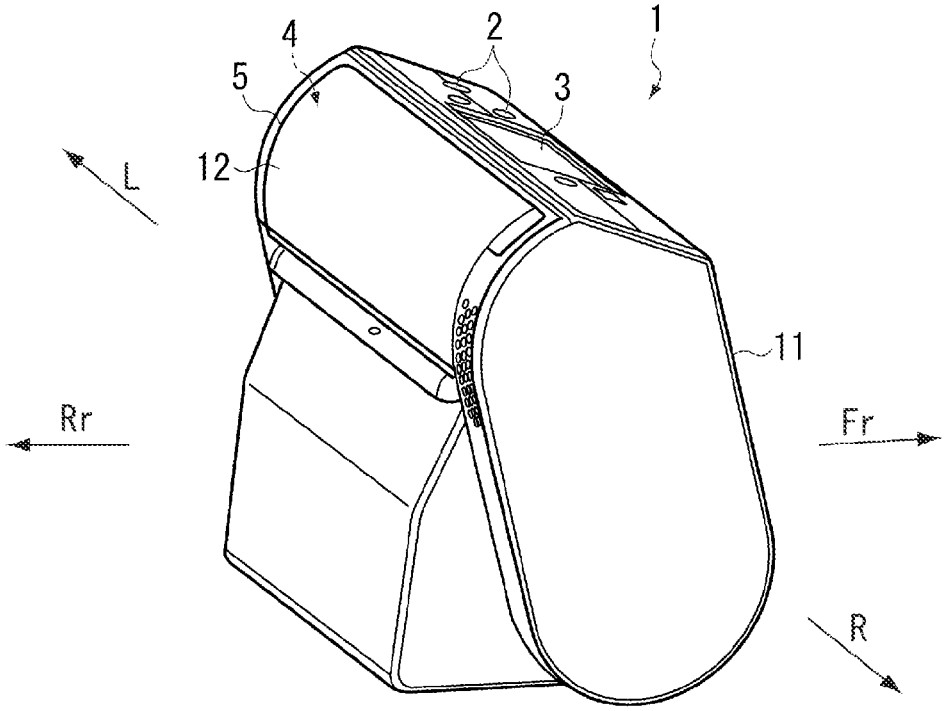
FIGS. 1A and 1B illustrate perspective views of states of closing and opening an open/close lid of a printing apparatus.
Figure 1B:
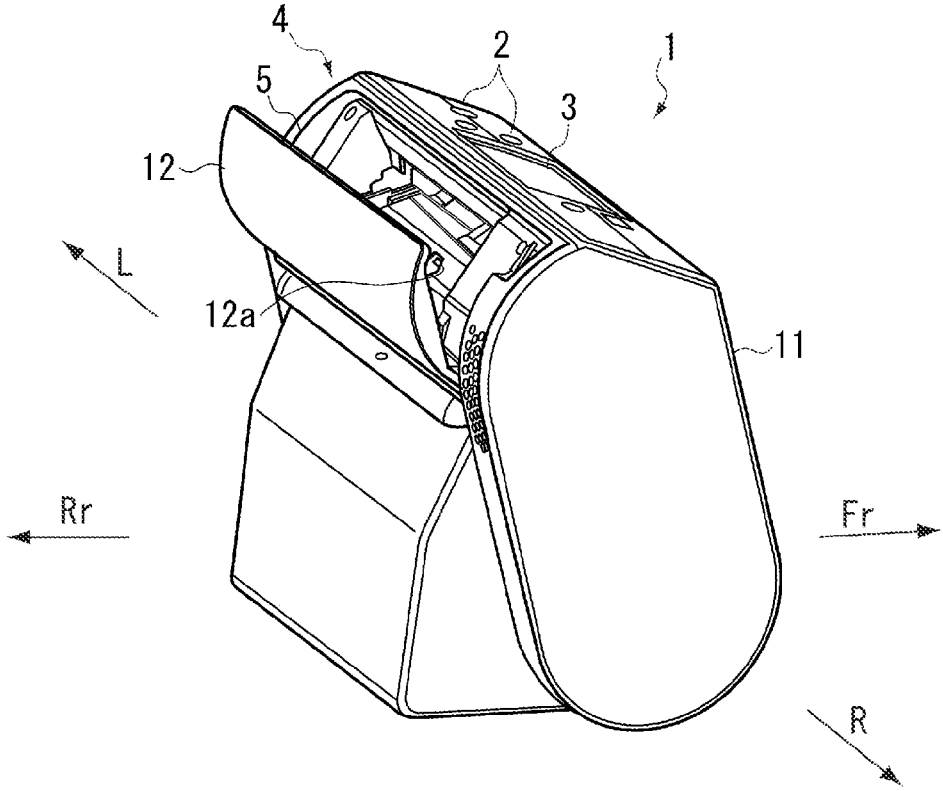

FIGS. 1A and 1B illustrate perspective views of closing and opening states of a open/close lid of the printer. Referring to FIGS. 1A and 1B, a printer 1 is formed by being shaped with an exterior member 11. In the obliquely upward on the front side, the printer 1 includes an operation unit 2 for setting the printing operation by a user and a display unit 3 for checking setting contents.

In the obliquely Upward on the back side of the printer 1, a paper stacking unit 4 is disposed to stack a recording paper that is discharged to the outside of the printer 1 after printing an image by the printer 1. The paper stacking unit 4 includes an opening portion 5 for externally discharging the recording paper from the printer 1, and an open/close lid 12 pivotally supported around a rotary shaft 11*a* (refer to FIGS. 4B and 6B) formed to the exterior member 11 at the adjacent position of the opening 5. The open/close lid rotates upon the rotary shaft its axis.

The opening portion 5 is a part of a paper conveyance path when discharging the recording paper. The open/close lid 12 can close or open the opening portion 5, i.e., the paper conveyance path. FIG. 1A illustrates a closing state of the opening portion 5 of the open/close lid 12. When dust or a foreign matter invades the printer 1 from the opening portion 5, the dust or foreign matter adhere to a thermal head or a member forming the paper conveyance path within the printer. Alternatively, the dust or foreign matter adheres to the recording paper housed therein or the recording paper at the print time, thereby damaging a print surface. Therefore, as illustrated in FIG. 1A, the open/close lid 12 is closed at non-print time, thereby preventing the dust or foreign matter from invading the printer 1 and improving the print quality. The print time means a printing state, a conveyance state of the recording paper, or a print suspension state. The non-print time means a non-printing state, a non-conveyance state of the recording paper, and a printing non-suspension state.

FIG. 1B illustrates a state in which the opening portion 5 of the open/close lid 12 is opened. According to the present exemplary embodiment, the open/close lid 12 is opened, and the front side of the open/close lid 12 and the opening 5 thus form the paper stacking unit 4. In the paper stacking unit 4, the open/close lid 12 supports the recording paper discharged upward from the opening portion 5 with maintaining longitudinal direction, thereby stacking a plurality of the recording papers. Therefore, the user can easily take out the recording paper from a print setting position. Both the functions as the dust-preventing lid and the paper stacking unit 4 are established to the open/close lid 12. Thus, the dust is prevented at the non-print time while the open/close lid 12 is closed. Further, the print convenience is improved without additionally attaching a paper discharge tray at the print time.

The printer 1 includes a printing unit (not illustrated), e.g., a thermal head for printing on the recording paper and a conveyance unit (not illustrated) for conveying the recording paper. The conveyance unit conveys the recording paper to the printing unit, or conveys downward the recording paper from the printing unit to discharge the recording paper upstream of the opening portion 5. As a consequence, the recording paper is stacked on the paper stacking unit 4.

Figure 2:
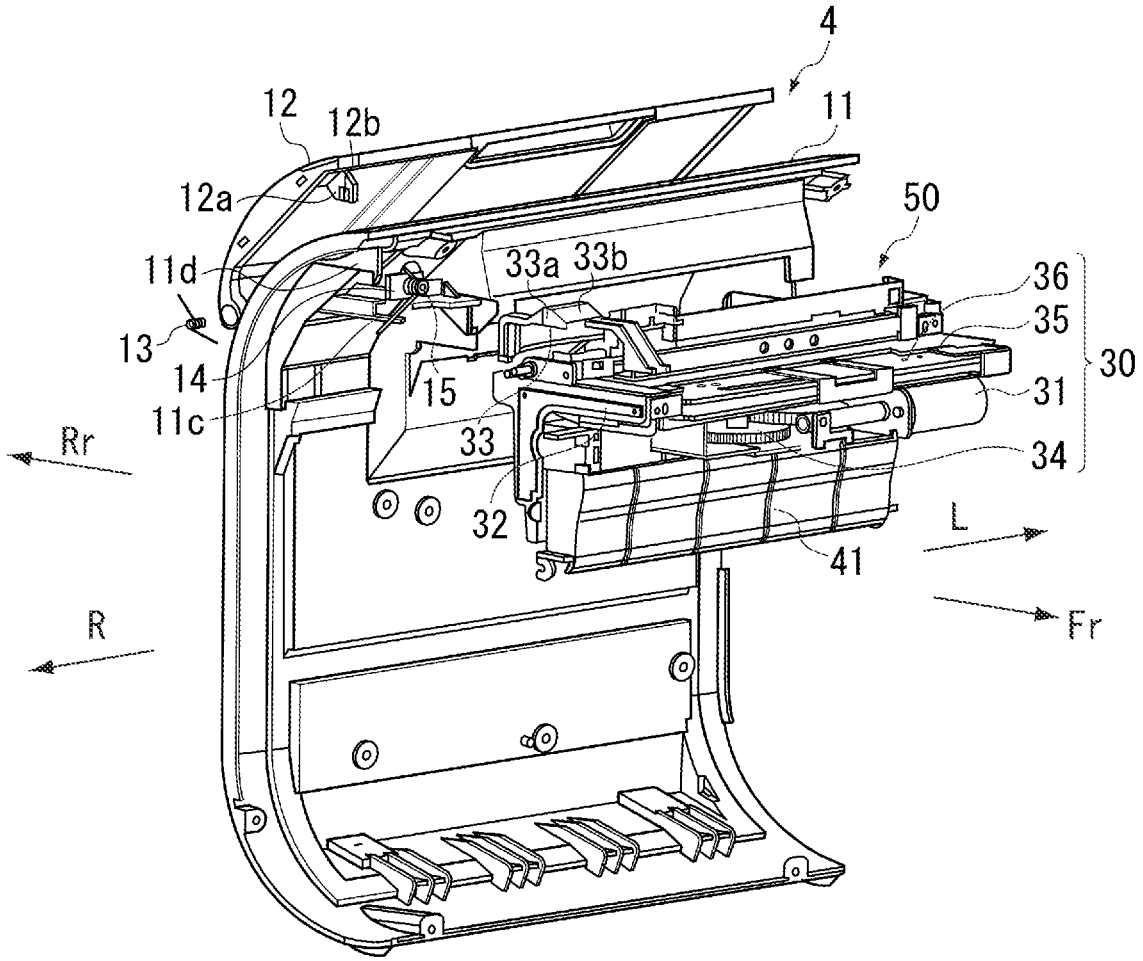
FIG. 2 illustrates an exploded perspective view of an internal configuration of a part of the printing apparatus.
Figure 3:
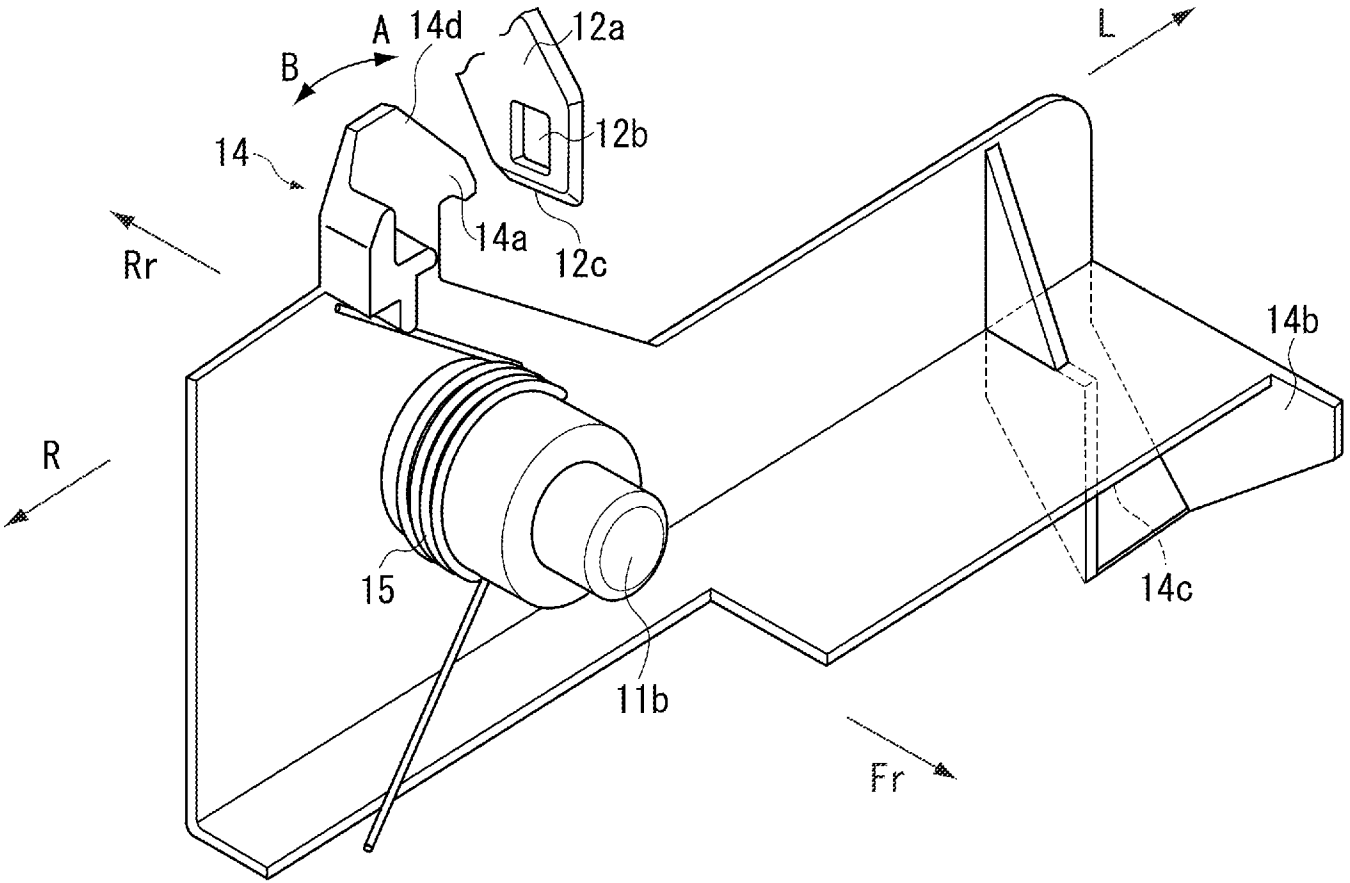
FIG. 3 illustrates a perspective view of a configuration of a locking member.

Next, a description is given of a configuration of locking the open/close lid 12 with reference to FIGS. 2 and 3. FIG. 2 illustrates an exploded perspective view of an internal configuration of a part of the printing apparatus. The open/close lid 12 is rotated around the rotary shaft 11*a* (refer to FIGS. 4B and 6B) of the exterior member 11 to be opened or closed. Near the rotary shaft 11*a*, a spring member 13 for urging the open/close lid in FIG. 2 is attached. The spring member 13 for biasing the open/close lid continuously biases the open/close lid 12 in the opening direction thereof. In front of the right side of the open/close lid 12, an engaging portion 12*a* is arranged to be projected ahead in the direction of the obliquely downward. An engaging hole 12*b* that is engaged with a locking member 14 is formed to the engaging portion 12*a*. An engaging portion of the open/close lid 12 is not limited to be hole-shaped like the engaging hole 12*b* but may be protrusion shaped.

On the right side in the printer 1, the locking member 14 is arranged to hold the open/close lid 12 in the closing state thereof. FIG. 3 illustrates a perspective view of a configuration of the locking member. Referring to FIG. 3, the locking member 14 is pivotally supported around the rotary shaft 11*b* disposed to the exterior member 11. Upward the locking member 14, a hook-shaped locking portion 14*a* is formed. The locking member 14 is rotated around the rotary shaft 11*b* in the direction of an arrow A in FIG. 3. As a consequence, the locking portion 14*a* fits in the engaging hole 12*b* of the open/close lid 12 in the closing state, thereby being engaged with the engaging portion 12*a*. Therefore, when the locking portion 14*a* of the locking member 14 is engaged with the engaging portion 12*a*, the open/close lid 12 biased in the opening direction can be held in the closing state. The locking portion 14*a* of the locking member 14 is rotated in the direction of an arrow B in FIG. 3 from the engagement state with the engaging portion 12*a*, and the engagement with the engaging portion 12*a* of the open/close lid 12 is thus released. The locking portion 14*a* of the locking member 14 is moved in the approximate horizontal direction as illustrated in FIG. 3, thereby enabling the engagement with the engaging portion 12*a* of the open/close lid 12 and releasing thereof.

A spring member 15 for biasing the locking member is attached to the locking member 14. One end of the spring member 15 for biasing the locking member abuts on a spring holding portion 11*c* (refer to FIG. 2) disposed to the exterior member 11. The other end of the spring member 15 for biasing the locking member abuts on a part of the locking member 14. Therefore, the spring member 15 for biasing the locking member continuously biases the locking portion 14*a* in the direction (of the arrow A in FIG. 3) for engagement with the engaging portion 12*a*. At the left end of the locking member 14, a cam follower portion 14*b* is formed projecting downward. A cam follower surface 14*c* that abuts on a cam surface 33*b* of a base member 33 is formed at a slant to the cam follower portion 14*b*.

Next, a description is given for an internal configuration of the printer 1 with reference to FIG. 2. The printer 1 includes the printing unit (not illustrated), a paper cutting mechanism 30, a paper conveyance guide member 41, a paper discharge mechanism 50 as a part of the conveyance unit, and a unit having a recording paper supply unit (not illustrated) that are positioned to the exterior member 11 and are further attached with screws. The paper cutting mechanism 30 is arranged adjacent to the paper stacking unit 4, and includes a drive motor 31, a gear array 34, a movable blade 35, and a fixed blade 36. In the paper cutting mechanism 30, the gear array 34 is rotated with the drive motor 31 as a power source, and the movable blade 35 is moved in the vertical direction (forward and backward in FIG. 2) of the recording paper, thereby cutting the recording paper. A lever member 32 is connected to the right end of the movable blade 35. The base member 33 is connected upper part of the lever member 32. Upper part of the base member 33, a cam unit 33*a* is formed protruding upward. The cam surface 33*b* that abuts on the cam follower surface 14*c* of the locking member 14 is formed to the cam unit 33*a* at a slant.

The movable blade 35, the lever member 32, and the base member 33 are integrally connected. Consequently, the lever member 32 and the base member 33 are simultaneously moved in conjunction with the operation in the forward and backward direction of the movable blade 35 that cuts the recording paper in the printer 1. With the movement of the base member 33, the rotation of the locking member 14 is regulated or permitted. A description is given for the operation of the locking member 14 by the base member 33 below.

The conveyance unit conveys downstream of the recording paper on which data is printed by the printing unit, and stops the conveyance at a predetermined position by a data signal having setting contents that are previously set at print setting time. With the energization to the drive motor 31 of the paper cutting mechanism 30, the movable blade 35 is moved to the fixed blade 36 side and the recording paper is thus cut, thereby forming the recording paper with a size (L size or 2L size) set by the user.

Figure 4A:
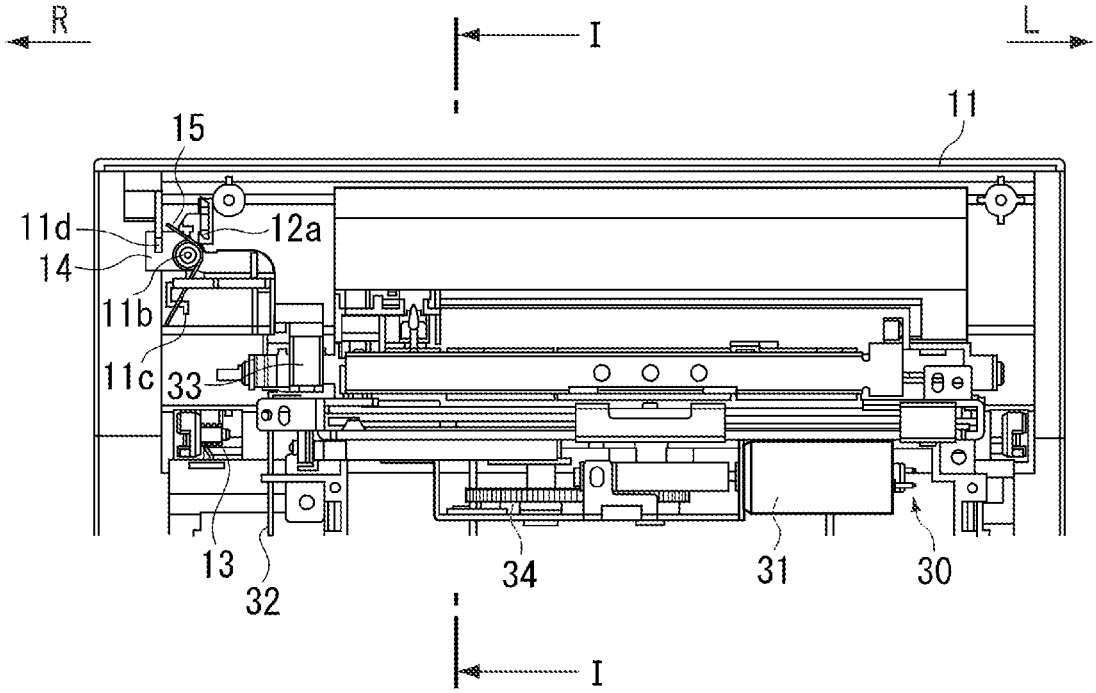
FIGS. 4A and 4B illustrate a configuration for holding the open/close lid in the closing state thereof at non-print time.
Figure 4B:
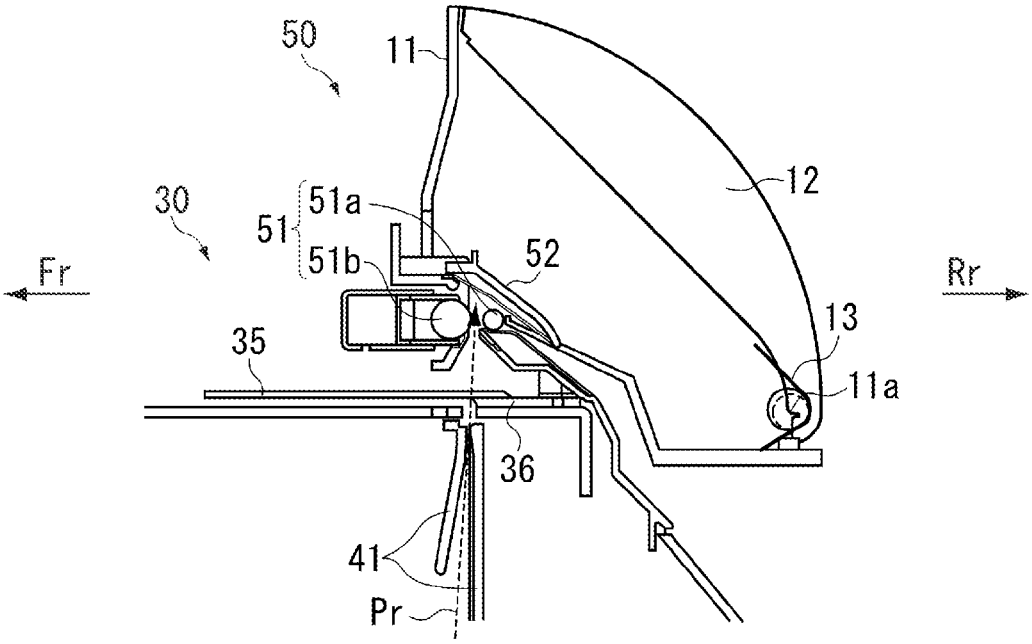

Next, a description is given for a configuration for holding the open/close lid 12 in the closing state thereof at the non-print time with reference to FIGS. 4A and 4B. FIG. 4A illustrates a front view of holding the open/close lid at the non-print time. FIG. 4B illustrates a cross-sectional view of a I-I line in FIG. 4A viewed from the direction of an arrow.

The open/close lid 12 is held in the closing state with a locking mechanism to prevent the dust or foreign matter from invading the printer 1 at the non-print time.

The locking mechanism includes the engaging portion 12*a* of the open/close lid 12 and the locking member 14 that can engage with the engaging portion 12*a*. Referring to FIG. 4A, by biasing the locking member 14 with the spring member 15 for biasing the locking member, the locking member 14 is rotated around the rotary shaft 11*b* at the non-print time, and engages with the engaging portion 12*a* of the open/close lid 12. At this time, a stopper 11*d* that abuts on the locking member 14 is projected from the exterior member 11 to reduce a load of the engaging portion 12*a* from the locking member 14 with biasing force of the spring member 15 for biasing the locking member (also refer to FIG. 2). The locking member 14 abuts on the stopper 11*d*, thereby regulating the rotation of the locking member 14 with a certain definite range or more thereof caused by biasing the locking member 14 with the spring member 15 for biasing the locking member.

Figure 5A:
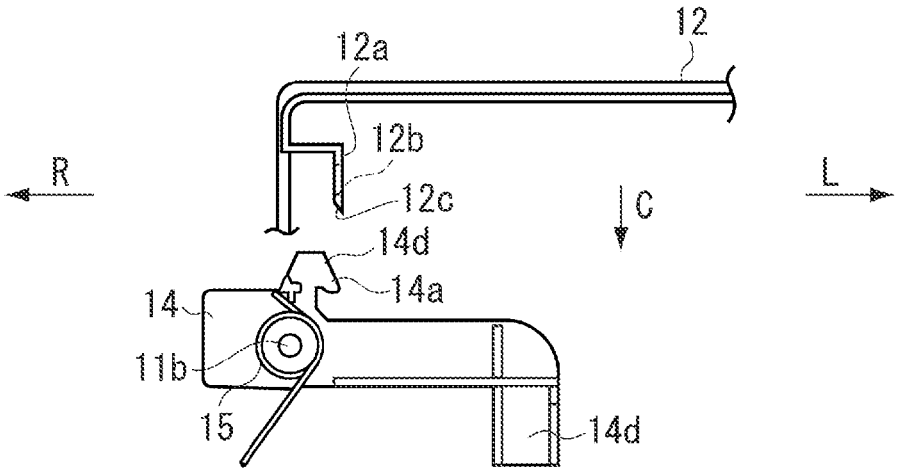
FIGS. 5A to 5C illustrate operations of the locking member when the open/close lid is closed at the non-print time.
Figure 5B:
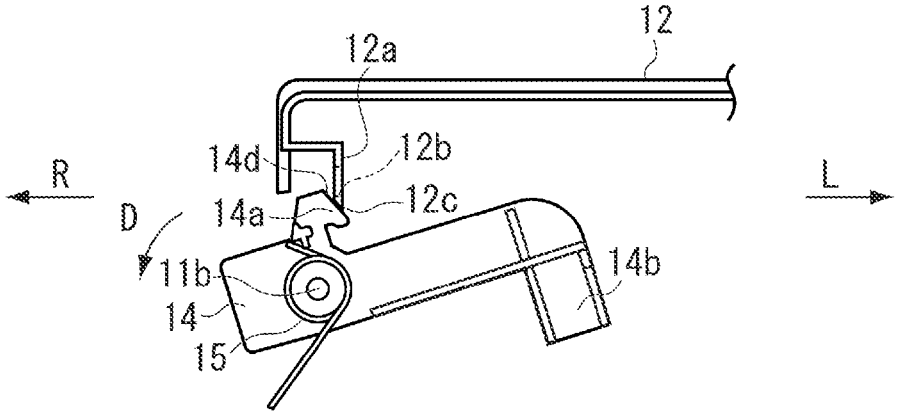
Figure 5C:
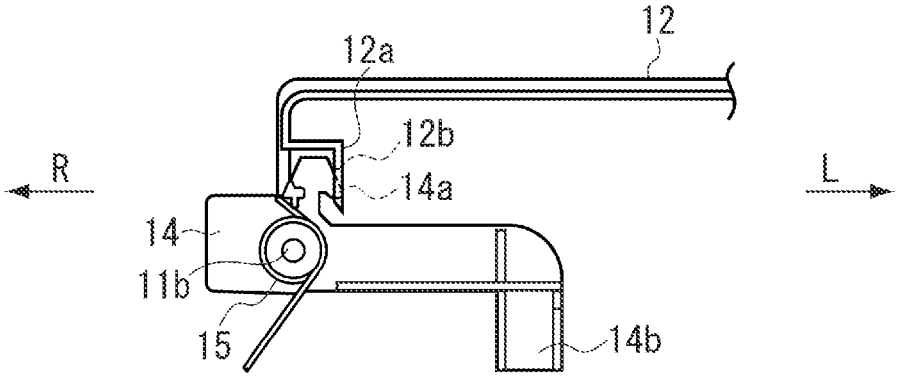

Even if the locking member 14 is at the position (locking position) for engagement with the engaging portion 12*a* of the open/close lid 12, the open/close lid 12 can be still opened. In this case, the user can manually close the open open/close lid 12. FIGS. 5A to 5C illustrate the operation of the locking member 14 when the user manually closes the open/close lid 12 at the non-print time.

Referring to FIG. 5A, when the locking member 14 is at the locking position, the user presses the open/close lid 12 in the direction of an arrow C. Referring to FIG. 5B, when closing the open/close lid 12, an abutting portion 12*c* at the bottom end of the engaging portion 12*a* of the open/close lid 12 abuts on an inclined guide portion 14*d* formed on the side face of the locking portion 14*a*. Further, the abutting portion 12*c* is in conjunction with the inclined guide portion 14*d*. Since the surface of the inclined guide portion 14*d* inclines, the force acting on the inclined guide portion 14*d* from the abutting portion 12*c* has component of force in direction R. At this time, with a load of the guide portion 14*d* of the locking member 14 from the abutting portion 12*c* of the engaging portion 12*a*, the locking member 14 is rotated around the rotary shaft 11*b* in the direction of an arrow D, against the biasing by the spring member 15 for biasing the locking member. According to the component of force in direction R, the locking member 14 rotates in direction D. In other words, the locking member 14 is moved at a retracting position from the locking position. Further, when closing the open/close lid 12, the locking portion 14*a* of the locking member 14 fits in the engaging hole 12*b* of the engaging portion 12*a*. Thus, the received load of the guide portion 14*d* is released. Referring to FIG. 5C, the locking portion 14*a* of the locking member 14 is engaged with the engaging portion 12*a* of the open/close lid 12.

Referring to FIG. 5C, even if the locking portion 14*a* of the locking member 14 is engaged with the engaging portion 12*a* of the open/close lid 12, the user can manually open the closed open/close lid 12. In this case, a handle may be disposed between the exterior member 11 and the open/close lid 12 to pull the open/close lid 12. The user pulls out the handle, thereby rotating the open/close lid 12 around the rotary shaft 11*a* and gradually opening the open/close lid 12 upward. The engaging portion 12*a* of the open/close lid 12 rotates the locking member 14 around the rotary shaft 11*b* against the biasing operation with the spring member 15 for biasing the locking member. Therefore, the locking member 14 is moved to the retracting position from the locking position. The user pulls out the open/close lid 12 to a predetermined distance, thereby completely releasing the engagement of the locking portion 14*a* of the locking member 14 with the engaging portion 12*a*. Then, the open/close lid 12 is opened by biasing force of the spring member 13 for biasing the open/close lid.

Next, a description is given for the state of the paper cutting mechanism at the non-print time with reference to FIG. 4B. The printer 1 includes paper conveyance guide members 41 that guide the recording paper on which data is printed by the printing unit. An interval between the paper conveyance guide members 41 is a part of a paper conveyance path Pr (refer to a broken line in FIG. 4B) of the recording paper. Downstream of the paper conveyance guide members 41, the paper cutting mechanism 30 including the movable blade 35 and the fixed blade 36 is provided. Referring to FIG. 4B, in the paper cutting mechanism 30, the movable blade 35 on the conveyance path Pr is moved backward so that the paper conveyance path Pr is closed at the non-print time. Specifically, in the paper cutting mechanism 30, the interval between the movable blade 35 and the fixed blade 36 is closed, thereby setting the conveyance path Pr to be closed with the movable blade 35. When the movable blade 35 is closed, the locking member 14 can hold the open/close lid 12 in the closing state thereof, which will be described below.

According to the present exemplary embodiment, an ink ribbon cassette or a roll paper cassette (not illustrated) can be attached/detached at the non-print time. The printer 1 includes an interlocking mechanism (not illustrated) that prevents the detachment of the ink ribbon cassette or roll paper cassette in the attaching state at the print time. When the interval between the movable blade 35 and the fixed blade 36 is closed, the interlocking mechanism is released and the ink ribbon cassette can be inserted or removed.

Figure 6A:
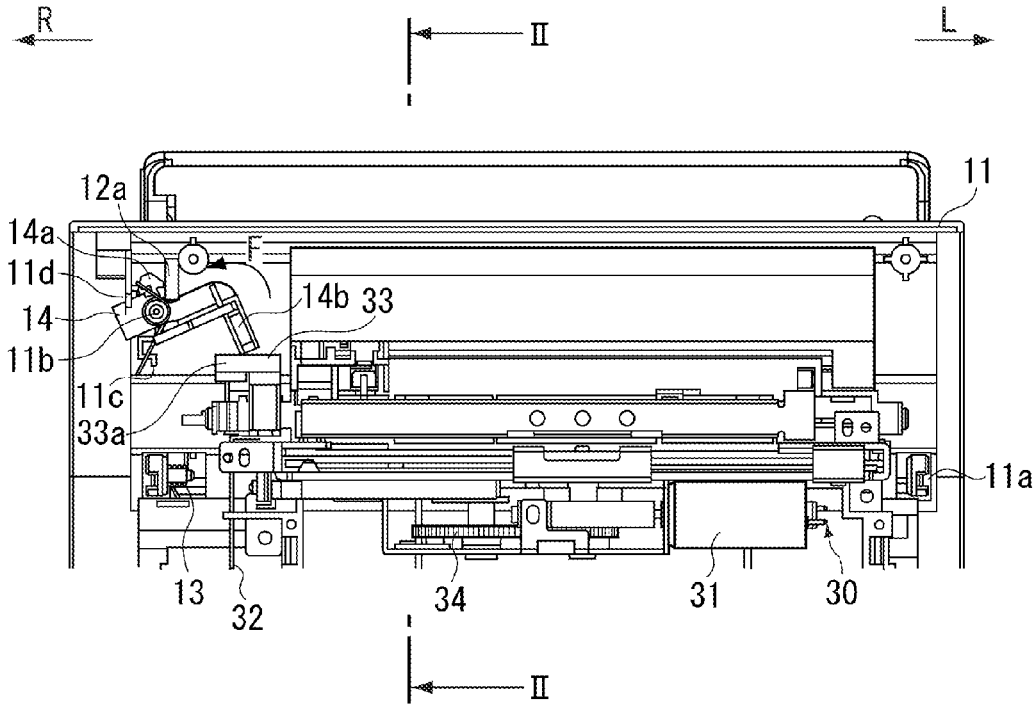
FIGS. 6A and 6B illustrate a configuration for releasing the hold of the open/close lid at print time.
Figure 6B:
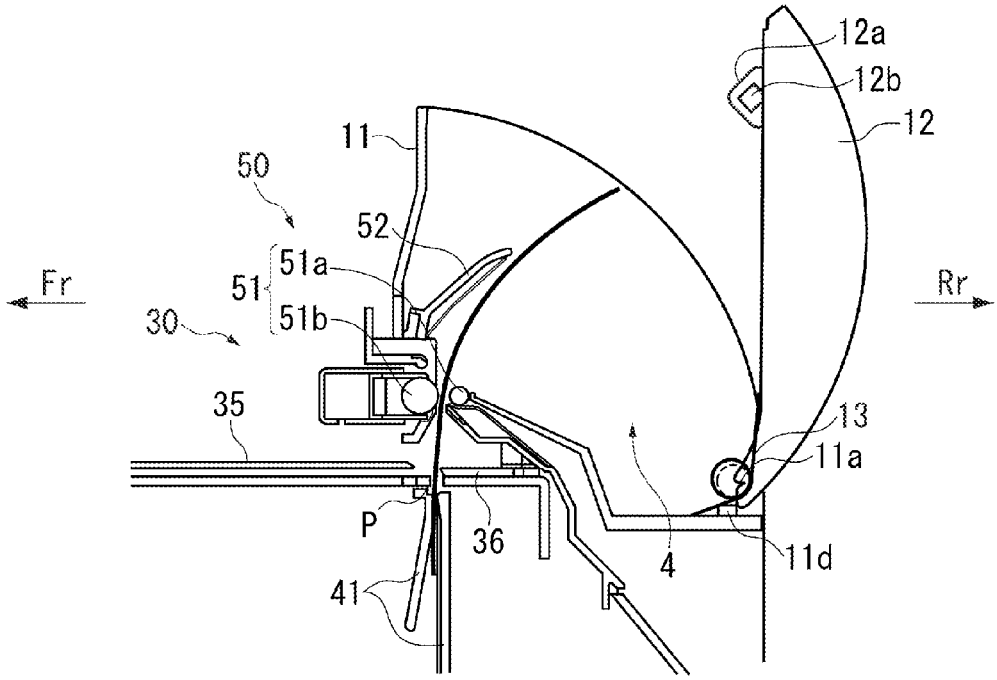

Next, a description is given for a configuration of releasing the holding state of the open/close lid at the print time with reference to FIGS. 6A and 6B. FIG. 6A illustrates a front view of releasing the holding state of the open/close lid at the print time. FIG. 6B illustrates a cross-sectional view of a II-II line in FIG. 6A from the direction of an arrow. To discharge the recording paper at the print time, the engagement of the open/close lid 12 held by the locking mechanism is released.

When starting the printing operation, in the printer 1, the recording paper supply unit conveys the recording paper to the printing unit, and the printing unit starts print processing on the recording paper. The drive motor 31 of the paper cutting mechanism 30 is energized, and the drive motor 31 thus rotates the gear array 34. In conjunction with the rotation of the gear array 34, the movable blade 35 is moved. Specifically, as illustrated in FIG. 6B, the movable blade 35 on the paper conveyance path is opened so that the paper conveyance path is opened at the print time. Specifically, the movable blade 35 is moved forward, and the interval between the movable blade 35 and the fixed blade 36 is opened. Thus, the paper conveyance path is opened by the movable blade 35. When the interval between the movable blade 35 and the fixed blade 36 is opened, the cassette interlocking mechanism is locked in conjunction with the opening state to control the operation to prevent the ink ribbon cassette from being taken out.

Figure 7:
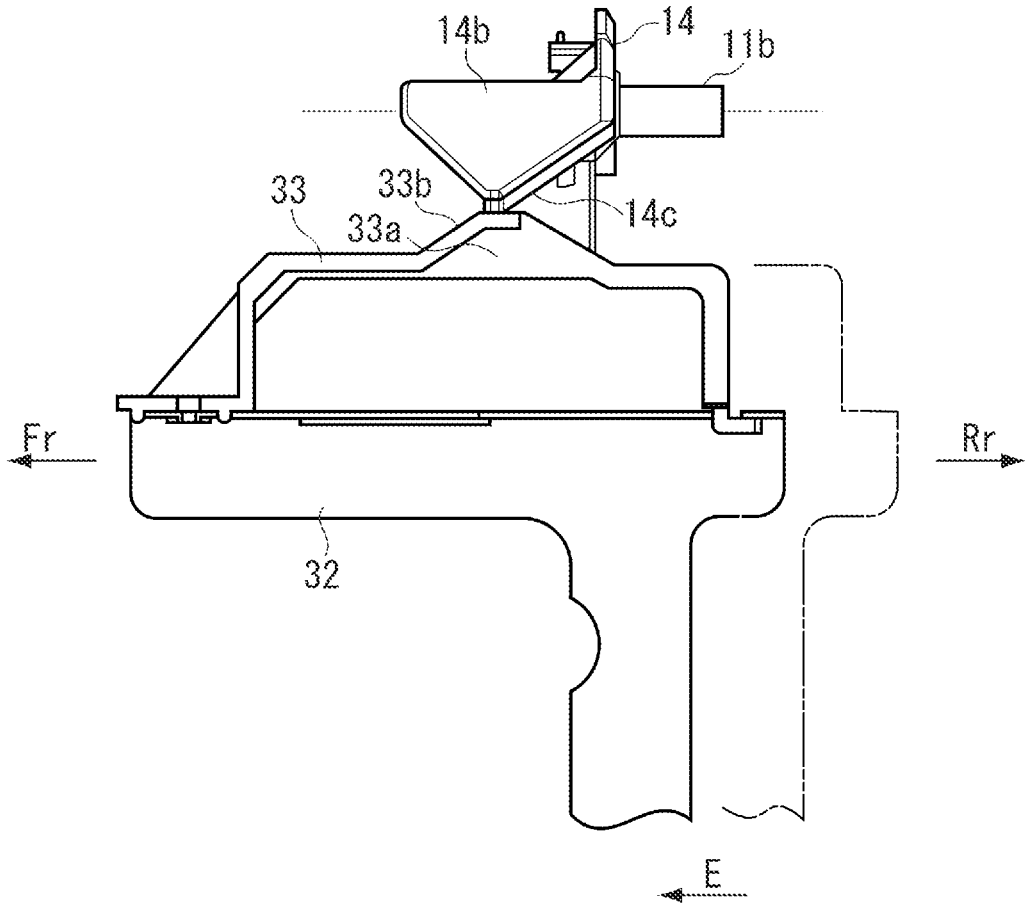
FIG. 7 illustrates a side view of a lever member, a base member, and a locking member from the left side.

As described above, the lever member 32 is connected to the movable blade 35. The base member 33 is connected to the lever member 32. Specifically, when the movable blade 35 is moved, the lever member 32 connected to the movable blade 35 and the base member 33 are similarly moved. FIG. 7 illustrates a side view of the lever member, the base member, and the locking member viewed from the left side. Referring to FIG. 7, the cam follower unit 14*b* of the locking member 14 is positioned in the upper direction of the base member 33. Therefore, in conjunction with the movable blade 35, the base member 33 is moved in the direction of an arrow E at a predetermined distance from the position illustrated by a chain double-dashed line to the position illustrated by a solid line. Thus, the cam unit 33*a* of the base member 33 abuts on the cam follower unit 14*b* of the locking member 14.

Specifically, the cam follower surface 14*c* of the locking member 14 abuts on the cam surface 33*b* of the base member 33. As the cam follower surface 14*c* of the locking member 14 abuts on the base member 33, the cam follower surface 14*c* is inclined downward. On the other hand, as the cam surface 33*b* of the base member 33 abuts on the locking member 14, the cam surface 33*b* is inclined upward. Therefore, after the cam follower surface 14*c* abuts on the cam surface 33*b*, the cam follower surface 14*c* is mutually slid to the cam surface 33*b*. As a consequence, the cam follower unit 14*b* of the locking member 14 is gradually moved upward along the cam surface 33*b*. At this time, the locking member 14 pivotally supported by the rotary shaft 11*b* is rotated in the direction of an arrow F with external force from the base member 33 as illustrated in FIG. 6A, against the biasing with the spring member 15 for biasing the locking member.

By rotating the locking member 14, the locking portion 14*a* of the locking member 14 is moved to the retracting position from the position at which the locking member 14 engages with the engaging portion 12*a* of the open/close lid 12, thereby releasing the holding state of the open/close lid 12. The open/close lid 12 whose holding state is released is rotated in the direction of opening the lid around the rotary shaft 11*a* by the biasing with the spring member 13 for biasing the open/close lid. Referring to FIG. 6B, the open/close lid 12 abuts on the stopper 11*d* to regulate the rotation. When the interval between the movable blade 35 and the fixed blade 36 is opened, the locking member 14 abuts on the base member 33. The locking portion 14*a* of the locking member 14 is thus held in the retracting state from the position at which the locking member 14 engages with the engaging portion 12*a* of the open/close lid 12.

Next, a description is given for the operation until the recording paper is stacked on the paper stacking unit 4 after ending the printing operation with reference to FIG. 6B. Referring to FIG. 6B, a recording paper P whose printing operation ends is conveyed to the paper discharge mechanism 50, and is sandwiched between a drive roller 51*a* and a driven roller 51*b* forming a paper discharge roller 51 of the paper discharge mechanism 50. The recording paper P is conveyed by the drive roller 51*a* and the driven roller 51*b* by the size set in the print setting, and is cut by the paper cutting mechanism 30. At this time, the movable blade 35 of the paper cutting mechanism 30 is moved backward, and the interval between the movable blade 35 and the fixed blade 36 is closed. Then, in conjunction with the closing state, the locking member 14 is temporarily moved to the position at which the locking member 14 engages with the engaging portion 12*a* of the open/close lid 12. However, the recording paper P that has been already cut is exposed at the opening portion 5, so that the open/close lid 12 is not carelessly closed by the user.

The drive roller 51*a* and the driven roller 51*b* convey the cut recording paper P further downstream. After the recording paper P is separated from the interval between the drive roller 51*a* and the driven roller 51*b*, a paper discharge guide member 52 in FIG. 6B presses out the recording paper P in the direction of the open/close lid 12. The open/close lid 12 guides the transfer of the recording paper P. Then, the recording paper P is stacked on the paper stacking unit 4.

After finishing the printing operation, the paper cutting mechanism 30 sets the closing state of the conveyance path Pr as illustrated in FIG. 4B. The base member 33 is transferred in the direction of releasing the abutment state on the locking member 14, in conjunction with the paper cutting mechanism 30. Therefore, the locking member 14 is returned to the position at which the locking member 14 engages with the engaging portion 12*a* of the open/close lid 12 by the biasing with the spring member 15 for biasing the locking member. The user manually closes the open/close lid 12, and the locking member 14 holds the closing state of the open/close lid 12 through processing in FIGS. 5A to 5C. If the printer 1 is in the power-off state, similarly to the state when the printing operation is ended, the paper cutting mechanism 30 sets the closing state of the conveyance path Pr.

In the sublimation printer according to the present exemplary embodiment, the paper cutting mechanism 30 does not immediately cut the recording paper P after conveying the recording paper P to be discharged to the outside of the printer 1 once, but the recording paper P is accommodated in the printer 1 again. The recording paper P enters/exits the opening portion 5 more than once so that the printing unit sublimates ink of ink ribbon such as yellow, magenta, cyan and overcoating to the recording paper P. During the paper conveyance operation, the paper cutting mechanism 30 is not operated and the paper conveyance path Pr is opened.

In continuous printing operation described above, a thermal head or a board of the printer 1 is heated. In this case, the printer 1 stops the energization, suspends the printing operation, and stops heating to prevent the rise of temperature in the printer 1 to a predetermined temperature or more. Because, when the ink of ink ribbon is sublimated to the recording paper P with the heat of the thermal head, if the temperature of the thermal head rises beyond necessity, the ink is sublimated more than needs and a phenomenon of deterioration in image quality occurs.

If the printing operation is suspended as described, although the printing operation is performed, the recording paper P is not discharged. Thus, the user misunderstands that the printing operation ends or does not start, and can carelessly close the open/close lid 12. Conventionally, if the open/close lid 12 is closed during the printing operation, the closing state of the open/close lid 12 is held. Then, upon restarting the printing operation, when the recording paper P in progress of conveyance is discharged to the opening portion 5 of the paper stacking unit 4, the leading edge of the recording paper P hits against the inside of the open/close lid 12.

However, according to the present exemplary embodiment, when the interval between the movable blade 35 and the fixed blade 36 is opened, the base member 33 is moved to the position shown by a solid line in FIG. 7. Therefore, the locking member 14 is retracted from the position at which the locking member 14 engages with the engaging portion 12*a* of the open/close lid 12, as illustrated in FIG. 6A. Even if the user carelessly closes the open/close lid 12 during the printing operation, the locking member 14 with which the engaging portion 12*a* is engaged is retracted. Thus, the closing state of the open/close lid 12 is not held. In other words, similarly to the case of starting the printing operation, the opening portion 5 of the printer 1 is opened. When discharging the recording paper P, the leading edge of the recording paper P does not abut on the open/close lid 12 to affect on the printing operation.

Conventionally, when starting the printing operation, the leading edge of the discharged recording paper P is certainly conveyed without hitting against the inside of the open/close lid 12. Thus, the user needs to open the open/close lid 12. However, according to the present exemplary embodiment, when starting the printing operation, since the interval between the movable blade 35 and the fixed blade 36 is opened, the locking member 14 engaged with the engaging portion 12*a* of the open/close lid 12 is retracted from the engagement position with the engaging portion 12*a* in conjunction with the movement of the movable blade 35. At this time, the open/close lid 12 is automatically opened by biasing force of the spring member 13 for biasing the open/close lid. Therefore, without opening the open/close lid 12 by the user, the leading edge of the recording paper P does not hit against the open/close lid 12 to affect on the printing operation.

According to the present exemplary embodiment, the locking member 14 can be moved to the position at which the locking member 14 engages with the open/close lid 12 or the retracting position from the position at which the locking member 14 engages with the open/close lid 12 in the closing state of the open/close lid 12. The locking member 14 is controlled to be interlocked with the operation of the paper cutting mechanism 30. Specifically, when the printing operation is not performed, the paper cutting mechanism 30 sets the closing state of the interval between the movable blade 35 and the fixed blade 36. Thus, the locking member 14 is moved to the position at which the locking member 14 engages with the open/close lid 12. In this case, the user closes the open/close lid 12, thereby holding the closing state of the open/close lid 12. Thus, it is possible to prevent a foreign matter from invading into the printer 1.

During the printing operation, just after starting the printing operation, in the paper cutting mechanism 30, the interval between the movable blade 35 and the fixed blade 36 is opened, thereby moving the locking member 14 to the retracting position from the position at which the locking member 14 engages with the open/close lid 12. In this case, even if the user closes the open/close lid 12, the closing state of the open/close lid 12 is not held. Therefore, the recording paper P does not hit against the inside of the open/close lid 12 to affect on the printing operation. The locking member 14 is interlocked with the operation of the paper cutting mechanism 30 and is thus driven. Therefore, an additional drive source is not required, so that the manufacturing costs of the printer 1 can be reduced. Since the paper cutting mechanism 30 is arranged adjacent to the locking member 14 as compared with other drive sources, the locking member 14 can be easily interlocked with the paper cutting mechanism 30 with a simple structure. The conventional complicated control or structure is not needed.

Furthermore, when the printing operation starts, and the paper cutting mechanism 30 opens the interval between the movable blade 35 and the fixed blade 36, the locking member 14 is retracted from the position at which the locking member 14 engages with the engaging portion 12*a*, thereby opening the open/close lid 12. Consequently, it is possible to prevent forgetting to open the open/close lid 12.

The exemplary embodiment of the present invention is described. The present invention is not limited to the exemplary embodiment, and can be changed within the range of the present invention. For example, according to the present exemplary embodiment, the open/close lid 12 serve as the lid of the opening portion 5 of the printer 1 and a part of the paper stacking unit 4. However, the present invention is not limited to this. For example, the open/close lid 12 may not be a part of the paper stacking unit 4, and the open/close lid 12 may have only a function as a dust preventing lid.

According to the present exemplary embodiment, the description is given for the case of arrangement in which the open/close lid 12 is adjacent to the opening portion 5 of the printer 1. However, the present invention is not limited to this. Any lid may be used as long as the open/close lid 12 opens or closes the paper conveyance path Pr of the recording paper P in the printer 1. According to the present exemplary embodiment, the description is given for the case where the open/close lid 12 is rotated around the rotary shaft 11*a*. The present invention is not limited to this, and an open/close lid with a slide structure may be used to close/open the paper conveyance path Pr.

According to the present exemplary embodiment, the description is given for the case where the locking member 14 is rotated around the rotary shaft 11*b* to be moved to the position at which the locking member 14 engages with the engaging portion 12*a* of the open/close lid 12 or the retracting position from the position at which the locking member 14 engages with the engaging portion 12*a*. However, the present invention is not limited to this. For example, the locking member may be slid with a slidable structure to be moved to the position at which the locking member 14 engages with the engaging portion 12*a* of the open/close lid 12 or the retracting position from the position at which the locking member 14 engages with the engaging portion 12*a*. In this case, the locking member can be biased with a spring in the direction of sliding, i.e., the direction for engaging with the engaging portion 12*a*. Further, the locking member can have an inclined guide portion that abuts on the abutting portion 12*c* of the open/close lid 12. The inclined guide portion may be formed to at least one of the locking portion 14*a* and the engaging portion 12*a* of the open/close lid 12.

According to the present exemplary embodiment, the description is given for the case where the base member 33 is connected to the lever member 32 and the base member 33 abuts on the locking member 14. However, the present invention is not limited to this. For example, the base member 33 and the lever member 32 may be integrally formed.

According to the present exemplary embodiment, the description is given for the case where the spring member 13 for biasing the open/close lid continuously biases the open/close lid 12 in the direction of opening thereof. However, the present invention is not limited to this. Force may be applied to the open/close lid 12 in the direction of opening the paper conveyance path Pr with self-weight or rubber. According to the present exemplary embodiment, the description is given for the case where the spring member 15 for biasing the locking member continuously biases the locking member 14 in the direction of engaging with the engaging portion 12*a* of the open/close lid 12. However, the present invention is not limited to this. Force may be applied to the locking member 14 in the direction of the engaging with the engaging portion 12*a* of the open/close lid 12 with self-weight or rubber.

According to the present exemplary embodiment, the description is given for the case of preventing the attachment/detachment of the ink ribbon cassette or roll paper cassette by the interlocking mechanism controlled by the movement of the movable blade 35 at the print time. However, the present invention is not limited to this case. For example, it may be prevented to attach/detach the ink ribbon cassette or roll paper conveying cassette in a state of ensuring the paper conveyance path of the recording paper or during conveying the recording paper.

According to the present exemplary embodiment, the sublimation printer is described as the printer 1. However, the present invention is not limited to this, and may be an another-type printer, a copying machine, a facsimile apparatus, or a printer provided for multifunction peripheral.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-163882 filed Jul. 21, 2010, which is hereby incorporated by reference herein in its entirety.

What is claimed is:

1. A printing apparatus comprising:

an open/close lid configured to close or open a conveyance path of a recording paper; and a locking member configured to hold a closing state of the open/close lid by engaging with an engaging portion of the open/close lid, and to be capable of moving to a position engageable with the engaging portion of the open/close lid or a position of retracting from the position engageable with the engaging portion of the open/close lid, a cutting mechanism configured to cut the recording paper, wherein the cutting mechanism includes a movable blade that moves in a direction approximately perpendicular to the conveyance path and a fixed blade, a base member configured to be operated in conjunction with the movable blade, wherein the locking member moves in conjunction with the movable blade since a cam which comes into contact with either one of the base member or the locking member is arranged to the other of the base member or the locking member, wherein the locking member moves to the position engageable with the engaging portion of the open/close lid when an interval between the movable blade and the fixed blade is closed at a non-print time, and further moves to the position of retracting from the position engageable with the engaging portion of the open/close lid when the interval between the movable blade and the fixed blade is opened at a print time.

2. The printing apparatus according to claim 1, wherein the locking member is pivotally supported and rotatable, and the locking member is rotated in one direction to be at the position engageable with the engaging portion of the open/close lid, and is rotated in another direction to be at the position of retracting from the position engageable with the engaging portion of the open/close lid.

3. The printing apparatus according to claim 1, wherein the locking member includes a locking portion engaging with the engaging portion of the open/close lid, and the locking portion moves in a direction approximately perpendicular to a movement direction of the movable blade to move to the position engageable with the engaging portion of the open/close lid or the position of retracting from the position engageable with the engaging portion of the open/close lid.

4. The printing apparatus according to claim 1, wherein the open/close lid is biased in a direction of opening the conveyance path.

5. The printing apparatus according to claim 1, wherein the locking member is biased in a direction of engaging with the engaging portion of the open/close lid.

6. The printing apparatus according to claim 1, wherein, when a power supply of the printing apparatus is off, the interval between the movable blade and the fixed blade is closed.

7. The printing apparatus according to claim 1, wherein the open/close lid is a part of a stacking unit that stacks the discharged recording paper via the conveyance path.

8. The printing apparatus according to claim 1, wherein the engaging portion of the open/close lid engages with the locking member to hold the open/close lid in the closing state, and when the locking member moves to the position of retracting from the position engageable with the engaging portion of the open/close lid, the open/close lid cannot be held in the closing state by engaging with the locking member.

* * * * *